US009144745B2

(12) United States Patent
Snyder et al.

(10) Patent No.: US 9,144,745 B2
(45) Date of Patent: Sep. 29, 2015

(54) SYSTEM AND APPARATUS FOR MAGNETIC SPIN CONTROL FOR TRACK-MOUNTED VEHICLES

(71) Applicant: S&S Worldwide, Inc., Logan, UT (US)

(72) Inventors: Todd Snyder, Nibley, UT (US); Mike Worley, Wellsville, UT (US); Alan Schilke, Liberty, UT (US)

(73) Assignee: S&S Worldwide, Inc., Logan, UT (US)

( * ) Notice: Subject to any disclaimer, the term of this patent is extended or adjusted under 35 U.S.C. 154(b) by 105 days.

(21) Appl. No.: 14/080,606

(22) Filed: Nov. 14, 2013

(65) Prior Publication Data

US 2015/0128824 A1 May 14, 2015

(51) Int. Cl.

| | |
|---|---|
| ***A63G 7/00*** | (2006.01) |
| ***B60L 13/04*** | (2006.01) |
| ***A63G 21/08*** | (2006.01) |
| ***A63G 27/02*** | (2006.01) |

(52) U.S. Cl.
CPC *A63G 7/00* (2013.01); *A63G 21/08* (2013.01); *A63G 27/02* (2013.01)

(58) Field of Classification Search
CPC ..... A63G 1/00; A63G 1/08; A63G 1/10; A63G 1/12; B60L 13/00; B60L 13/03; B60L 13/14
USPC ..... 104/53, 55–57, 281–284
See application file for complete search history.

(56) References Cited

U.S. PATENT DOCUMENTS

| | | | |
|---|---|---|---|
| 4,690,064 | A | 9/1987 | Owen |
| 5,325,790 | A | 7/1994 | Drayer |
| 5,715,756 | A | 2/1998 | Weigand et al. |

(Continued)

FOREIGN PATENT DOCUMENTS

| | | |
|---|---|---|
| CN | 201186616 Y | 1/2009 |
| DE | 25 40 547 | 3/1977 |

(Continued)

OTHER PUBLICATIONS

Maurer Söhne, MAURERXtendedSC2000, "Spinning Coaster for the perfect Xtended introduction," http://www.maurer-rides.com/files/amusement/pdf/P_SC2000_en.pdf, printed Aug. 27, 2013, 8 pgs.

*Primary Examiner* — R. J. McCarry, Jr.
(74) *Attorney, Agent, or Firm* — John R. Thompson; Stoel Rives LLP

(57) ABSTRACT

An apparatus for magnetic spin control includes a main chassis, a passenger chassis, a circular magnetic array, and a chassis-mounted fin. The main chassis is configured to ride on a track. The passenger chassis is rotatably supported on the main chassis and the passenger chassis is configured to support one or more passengers. The circular magnetic array is coupled to the passenger chassis such that the passenger chassis rotates with the circular magnetic array. The chassis-mounted fin is coupled to the main chassis and extends into a magnetic field of the circular magnetic array. The chassis-mounted fin includes a conductive material and operates as an eddy current brake to dampen rotation of the passenger chassis with respect to the main chassis. The chassis-mounted fin extends into the magnetic field and leaves at least a portion of the magnetic field unobstructed to allow a track-mounted fin to pass into the magnetic field. The circular magnetic array is configured to interact with a system of track mounted fins. The chassis-mounted fin provides rotational dampening of the passenger chassis, while the track-mounted fin(s) induce or inhibit rotation of the passenger chassis.

20 Claims, 5 Drawing Sheets

(56) References Cited

U.S. PATENT DOCUMENTS

| | | | | |
|---|---|---|---|---|
| 5,738,017 | A | 4/1998 | Behringer | |
| 5,947,030 | A | 9/1999 | Spieldiener et al. | |
| 6,513,441 | B1 | 2/2003 | Clerx et al. | |
| 6,659,237 | B1 | 12/2003 | Pribonic | |
| 7,303,054 | B2 | 12/2007 | Rosner | |
| 7,594,473 | B2 | 9/2009 | Kitchen et al. | |
| 7,640,862 | B2 | 1/2010 | Zamperla | |
| 7,836,829 | B2 | 11/2010 | Burger | |
| 7,918,740 | B2 * | 4/2011 | Kitchen et al. | 472/36 |
| 7,921,781 | B2 | 4/2011 | Baker et al. | |
| 8,020,494 | B2 | 9/2011 | Smith et al. | |
| 8,066,576 | B2 | 11/2011 | Threlkel | |
| 8,517,847 | B2 | 8/2013 | Crawford et al. | |
| 2003/0000415 | A1 | 1/2003 | Lamb et al. | |
| 2009/0031914 | A1 | 2/2009 | Hahn et al. | |
| 2013/0130817 | A1 | 5/2013 | Barber | |

FOREIGN PATENT DOCUMENTS

| | | | |
|---|---|---|---|
| DE | 10 2006 054116 | B3 | 4/2008 |
| JP | 2000 070554 | A | 3/2000 |
| WO | WO 2006/127446 | A1 | 11/2006 |

* cited by examiner

SYSTEM AND APPARATUS FOR MAGNETIC SPIN CONTROL FOR TRACK-MOUNTED VEHICLES

TECHNICAL FIELD

The present disclosure relates to amusement rides and more particularly relates to magnetic spin control for amusement rides with a track-mounted vehicle.

BRIEF DESCRIPTION OF THE DRAWINGS

The written disclosure herein describes illustrative embodiments that are non-limiting and non-exhaustive. Reference is made to certain illustrative embodiments that are depicted in the figures, in which.

DETAILED DESCRIPTION OF PREFERRED EMBODIMENTS

Roller coasters and other amusement rides often ride on tracks. With roller coasters, a vehicle carrying one or more passengers may be raised along a track to a high point where the vehicle can be released to roll down the track to gain speed and momentum for the amusement ride. A variety of twists, turns, and loops may be used to enhance the experience for the passengers.

The present application discloses systems, devices, and methods for magnetic spin control on roller coasters and other amusement rides. In one embodiment, for example, a system of the present disclosure provides for magnetic spin control, including inducing and inhibiting spinning of a passenger chassis.

Figure 1:
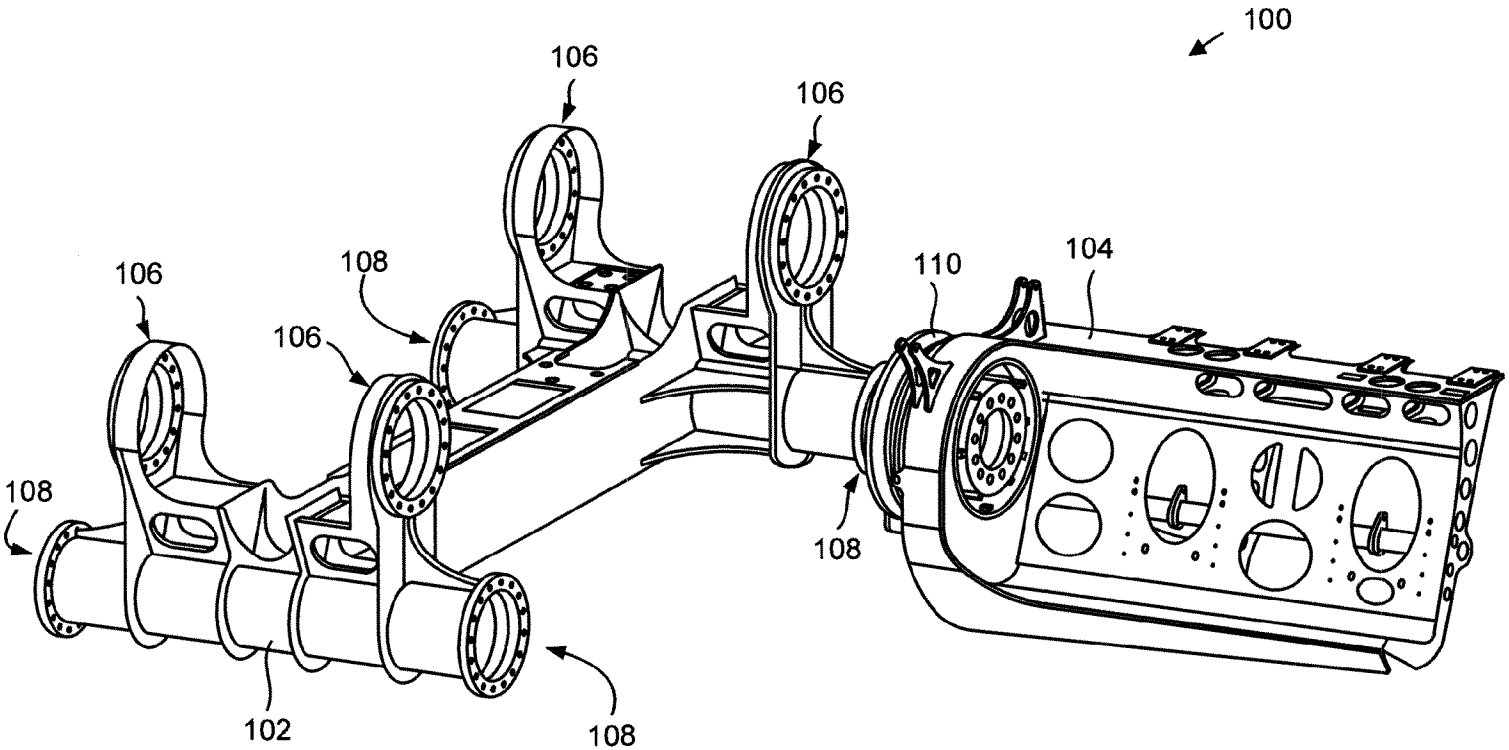
FIG. 1 illustrates an isometric perspective view of an amusement ride vehicle consistent with embodiments of the present disclosure.

FIG. 1 is a perspective view of one embodiment of a main chassis 102 and passenger chassis 104 of an amusement ride vehicle 100. The vehicle 100 may be configured to ride on a track and carry passengers on the passenger chassis 104. Many components which may be included in some embodiments are omitted for simplicity and to avoid obscuring the disclosure. For example, wheels, seats, and additional passenger chassis 104, which may be included in some embodiments, are not shown.

The main chassis 102 includes a frame with structures to secure the vehicle 100, including the main chassis 102 and the passenger chassis 104 to a track, rail, or other guide system. The main chassis 102 includes a plurality of wheel supports 106 for supporting wheels (not shown) that engage a track or rail of a guide system. For example, each of the wheel supports 106 may pivotally support one or more wheels (e.g., see FIG. 3) to engage a rail while allowing the main chassis 102 to move in relation to the track with low friction.

The main chassis 102 also includes a plurality of passenger chassis supports 108. The passenger chassis supports 108 may be configured to each support a passenger chassis 104.

The number of passenger chassis supports 108 may vary based on how many passenger chassis 104 may be included with the vehicle 100. For example, the main chassis 102 of FIG. 1 includes four passenger chassis supports 108, while other embodiments may include any number of passenger chassis without limitation. However, only one passenger chassis 104 is shown mounted to the main chassis 102.

The passenger chassis 104 includes a chassis for supporting one or more passengers. In FIG. 1, the passenger chassis 104 is configured to support one or more seats. In varying embodiments, the passenger chassis 104 may include one or more harnesses, belts, or other members for securing a passenger to or in the passenger chassis 104. In one embodiment, the passenger chassis 104 provides support of a passenger while allowing the passenger to be free from surrounding obstructions. For example, a passenger sitting on the passenger chassis 104 may be substantially free from structures in front, above, and/or to the side of the passenger. In other embodiments, other configurations for the passenger chassis 104 may provide a support for the passenger without obstructions in substantially every direction.

The passenger chassis 104 is configured to couple to a passenger chassis support 108 of the main chassis 102 such that the passenger chassis 104 extends laterally from the main chassis 102. Because the main chassis 102 couples to a track, rail, or other guide system, the passenger chassis 104 may extend laterally to the side of the track, rail, or guide system to give a passenger a sensation of flying freely to the side of the track, rail, or guide system. Furthermore, with little structure surrounding a passenger, the passenger may be exposed to the surroundings in a manner that provides for a more exhilarating ride. The passenger chassis 104 may be mounted to face forward or rearward with respect to the vehicle direction of travel. In one embodiment, on passenger chassis 104 may face forward while another passenger chassis 104 may face rearward with respect to the vehicle direction of travel.

The passenger chassis 104 is coupled to the passenger chassis support 108 of the main chassis 102 using a magnetic spin hub 110. The magnetic spin hub 110 allows the passenger chassis 104 to rotate with respect to the main chassis 102. For example, the magnetic spin hub 110 may include a joint that allows the passenger chassis 104 to spin or rotate about a horizontal axis of the passenger chassis 104 and/or the passenger chassis support 108. The magnetic spin hub 110 may include ball bearings or other low friction joint that allows the relative rotation of the passenger chassis 104 and the main chassis 102.

In one embodiment, the passenger chassis 104 may be weighted to return to a default position. For example, the passenger chassis 104 may be allowed to rotate with respect to the main chassis 102 and return to a default position where passengers are oriented in a vertical sitting position, or other desirable position. In one embodiment, the passenger chassis 104 may be weighted to return to a default position while taking the weight of any passengers into account. For example, the passenger chassis 104 may be weighted to offset imbalances that may occur when carrying passengers.

Figure 2:
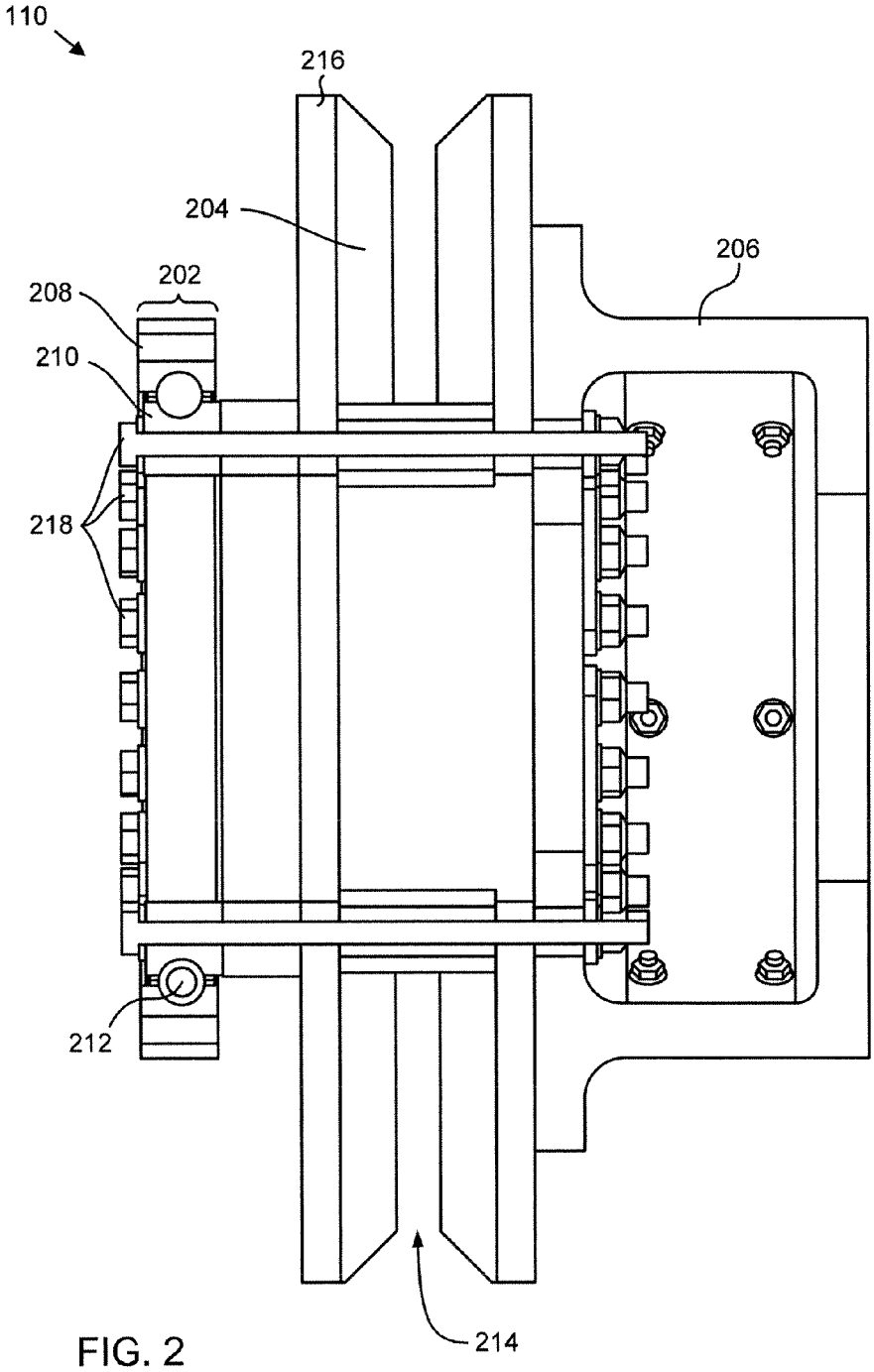
FIG. 2 illustrates a cross-sectional view of a magnetic spin hub consistent with embodiments of the present disclosure.

In one embodiment, the magnetic spin hub 110 includes a circular magnetic array that creates a magnetic field that can be used to control rotation of the passenger chassis 104. FIG. 2 is a cross sectional view of one embodiment of a magnetic spin hub 110. The magnetic spin hub 110 of FIG. 2 includes a slewing bearing 202, a circular magnetic array 204, and a coupling member 206. In one embodiment, the magnetic spin hub 110 allows for spin control of a passenger chassis 104. For example, the magnetic spin hub 110 may allow a passenger chassis 104 to rotate with respect to a main chassis 102 and spin or rotation of the passenger chassis 104 may be controlled by interacting with a magnetic field of the magnetic spin hub 110.

The slewing bearing 202 allows the spin hub 110 to rotate with respect to a main chassis 102. The slewing bearing 202 may include a first ring 208 that may be attached to the main chassis 102 and a second ring 210 that may be fixed with respect to the spin hub 110. The first ring 208 and second ring 210 ride on one or more bearings 212 relative to each other. For example, the first ring 208 of the slewing bearing 202 may be fixed to the main chassis 102, while the second ring 210 allows the spin hub 110 and/or an attached passenger chassis 104 to rotate with respect to the first ring 208 and/or main chassis 102. The slewing bearing 202 may include any type of slewing bearing and may be configured to support the load of the passenger chassis 104 and any passengers. The slewing bearing 202 is only one embodiment of a joint or bearing that may be used to allow the spin hub 110 and/or passenger chassis 104 to rotate with respect to the main chassis 102.

The circular magnetic array 204 creates a magnetic field that may be used to control rotation or spinning of the spin hub 110. In the depicted embodiment, the circular magnetic array 204 includes a plurality of magnets on opposite sides of a gap 214. The magnets of the circular magnetic array 204 may be arranged to create a magnetic field within the gap 214. For example, magnets on opposite sides of the gap 214 may be arranged to provide opposite electric fields such that the magnetic field within the gap 214 is maximized. Similarly, the magnets of the circular magnetic array 204 may be arranged to minimize the creation of a magnetic field outside of the circular magnetic array 204. In one embodiment, the circular magnetic array 204 includes a guide plate 216, which guides magnetic fields and/or contains the magnetic field to a desired location, such as within the gap 214. The magnets of the circular magnetic array 204 may include permanent magnetics or may include electromagnets, which can be controlled to provide variations in the magnitude and/or direction of the magnetic field.

The magnets in the magnetic array 204 may be arranged to create a varying magnetic field within the gap 214. For example, the magnets may be arranged to create an alternating magnetic field within the gap 214, such that the magnetic field at a given position within the gap 214 will change as the spin hub 110 rotates.

Although FIG. 2 only illustrates a single gap 214 on the magnetic spin hub 110, more than one gap 214 may be included in some embodiments. For example, multiple circular magnetic arrays 204 may form two or more gaps such that more than one fin may extend into a gap 214 from the same side of the magnetic spin hub. In one embodiment, a greater number of gaps can increase the amount of force that can be imparted towards inducing or inhibiting rotation of the passenger chassis 104.

In yet another embodiment, the magnetic array 204 may not include opposing magnets which form a gap. For example, the magnetic array 204 may include an array of magnets that create a magnetic field to a side of the magnetic array 204 but not within a gap. For example, a fin in proximity to a magnet or magnetic array may induce or inhibit rotation by extending to a magnetic field of the magnetic array 204. In one embodiment, the amount of force created between the fins and the magnetic array 204 may be varied by positioning the fin at a desired distance from the magnetic array. For example, a fin that is positioned closer to the magnetic array 204 may result in a greater force while a fin that is positioned further away may result in a reduced amount of force.

The coupling member 206 provides an interface to couple to a passenger chassis 104. For example, the passenger chassis 104 may be coupled to the spin hub 110 with bolts or other fasteners such that the passenger chassis 104 rotates with the spin hub 110.

The coupling member 206, circular magnetic array 204, and slewing bearing 202 are coupled together using bolts 218.

Figure 3:
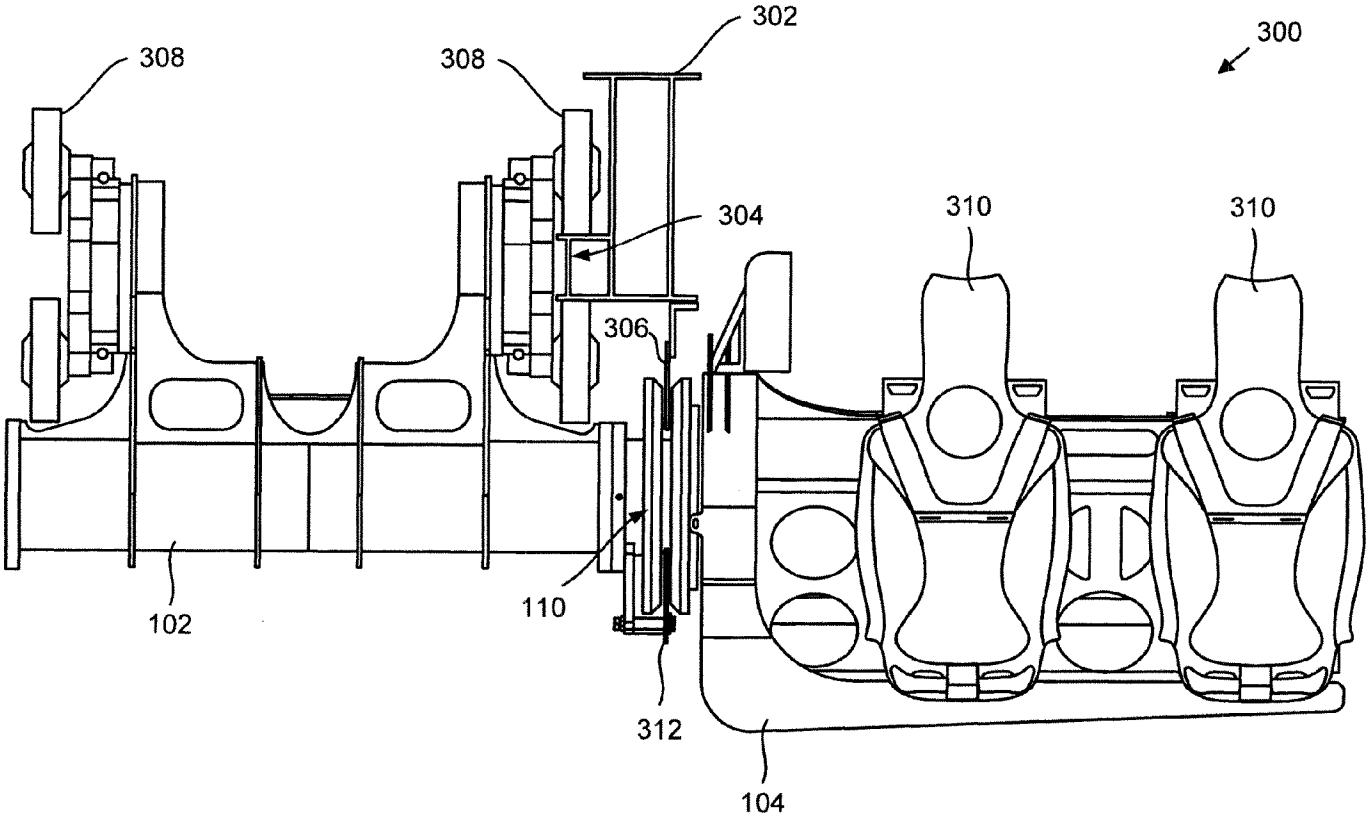
FIG. 3 illustrates a plan view of an amusement ride vehicle consistent with embodiments of the present disclosure.

FIG. 3 is a plan view of a portion of one embodiment of an amusement ride system 300. Depending on how a passenger chassis 104 is mounted on a main chassis, the view of FIG. 3 may be a front view or rear view of the amusement ride system 300. The system 300 includes a vehicle and a track 302. The track 302 includes a rail 304 on which the vehicle rides and a frame for supporting the rail 304. Although the system 300 of FIG. 3 will generally include two rails 304 to support the vehicle depicted in FIG. 3, some embodiments may include fewer or additional rails. In FIG. 3, only one rail 304 is shown to avoid obscuring the disclosure. The track 302 also includes a track-mounted fin 306 for controlling spin of the vehicle. Spin control will be discussed further below.

The vehicle includes a main chassis 102, a passenger chassis 104, and a magnetic spin hub 110 similar to the vehicle 100 of FIG. 1. The vehicle also includes wheels 308 mounted on the main chassis 102 for riding on the rail(s) 304 of the track 302. The wheels 308 allow the vehicle to be coupled with the track 302, but move in relation to the track 302 with low friction. The vehicle also includes seats 310 mounted on the passenger chassis 104 for supporting a passenger on the vehicle. The seats 310 may also include a harness, belt, and/or other securing system for securing the passenger to the vehicle. The vehicle also includes a chassis-mounted fin 312.

The track-mounted fin 306 and chassis-mounted fin 312 are configured to interact with a magnetic field of the spin hub 110 to provide control of rotation of the passenger chassis 104. In one embodiment, the fins 306 and 312 include a conductive material that operates to resist movement of the fins 306, 312 with respect to the magnetic field of the magnetic spin hub 110. In one embodiment, the fins 306, 312 and spin hub 110 may oppose rotation with respect to each other. For example, due to Lenz's law, the conductivity of the fins and the changing direction and/or magnitude of the magnetic field in the gap 214 creates a force to oppose relative movement. As will be understood by one of skill in the art, similar principles are used in eddy current brakes or inductive brakes. For example, the fins 306 and 312 can be described as operating as eddy current breaks to slow relative rotation of the fins 306, 312 with respect to the spin hub 110. However, slowing relative rotation between the fins 306, 312 and the spin hub 110 may involve acceleration of the rotation of the passenger chassis 104, depending on location of the fins 306, 312 and/or a relative speed of the vehicle to the fins 306, 312.

In one embodiment, the chassis-mounted fin 312 is fixed relative to the main chassis 102 and extends into a gap 214 of the spin hub 110 to interact with the magnetic field in the gap 214. Because the chassis-mounted fin 312 opposes relative movement of the spin hub 110, the rotation of the passenger chassis 104 with respect to the main chassis 102 is inhibited or dampened. For example, the chassis-mounted fin 312 may interact with the magnetic field in the gap 214 to cause rotation of the passenger chassis 104 to slow over time, or to reduce how quickly the passenger chassis 104 will turn with respect to the main chassis 102. In one embodiment, if the main chassis is rotating (e.g. turning to move up a slope, turning to move down a slope, or traveling on a loop portion of the track) the chassis-mounted fin 312 may interact with the magnetic field to provide a force inducing the passenger chassis 104 to rotate with the main chassis 102.

In one embodiment, the track-mounted fin 306 is fixed relative to the track 302 and/or track rail 304. The track-mounted fin 306 is positioned on the track to extend into the gap 214 of the spin hub 110 when the vehicle travels on a corresponding portion of the track 302. For example, the chassis-mounted fin 312 may extend into the gap 214 from a first side and leave a second side unobstructed so that the track-mounted fin 306 can pass into the gap 214. The track-mounted fin 306, when extending into the gap 214, operates to provide a force to cause rotation of the passenger chassis 104 to match a relative speed between the track 302 and the vehicle. For example, if the passenger chassis 104 is rotating and the vehicle is substantially stationary with respect to the track, the track-mounted fin 306 may interact with a magnetic field of the spin hub 110 to produce a force that opposes rotation of the passenger chassis 104. On the other hand, if the passenger chassis is substantially rotationally stationary with respect to the main chassis 102 and the vehicle is moving, with respect to the track 302, the track-mounted fin 306 may interact with the magnetic field to produce a force that induces or accelerates rotation of the passenger chassis 104.

The amount of force created by the fins 306, 312 and spin hub 110 to control rotation may vary based on a variety of factors. For example, a magnitude of a magnetic field in the gap 214, a magnitude of the change of the magnetic field per unit distance, an amount of area within the gap occupied by the fins, conductivity of the fins, a thickness of the fins, relative speed between the fins and the magnets in the spin hub 110, and the like all may affect the amount of force created by the spin hub 110 and fins 306, 312.

Figure 4:
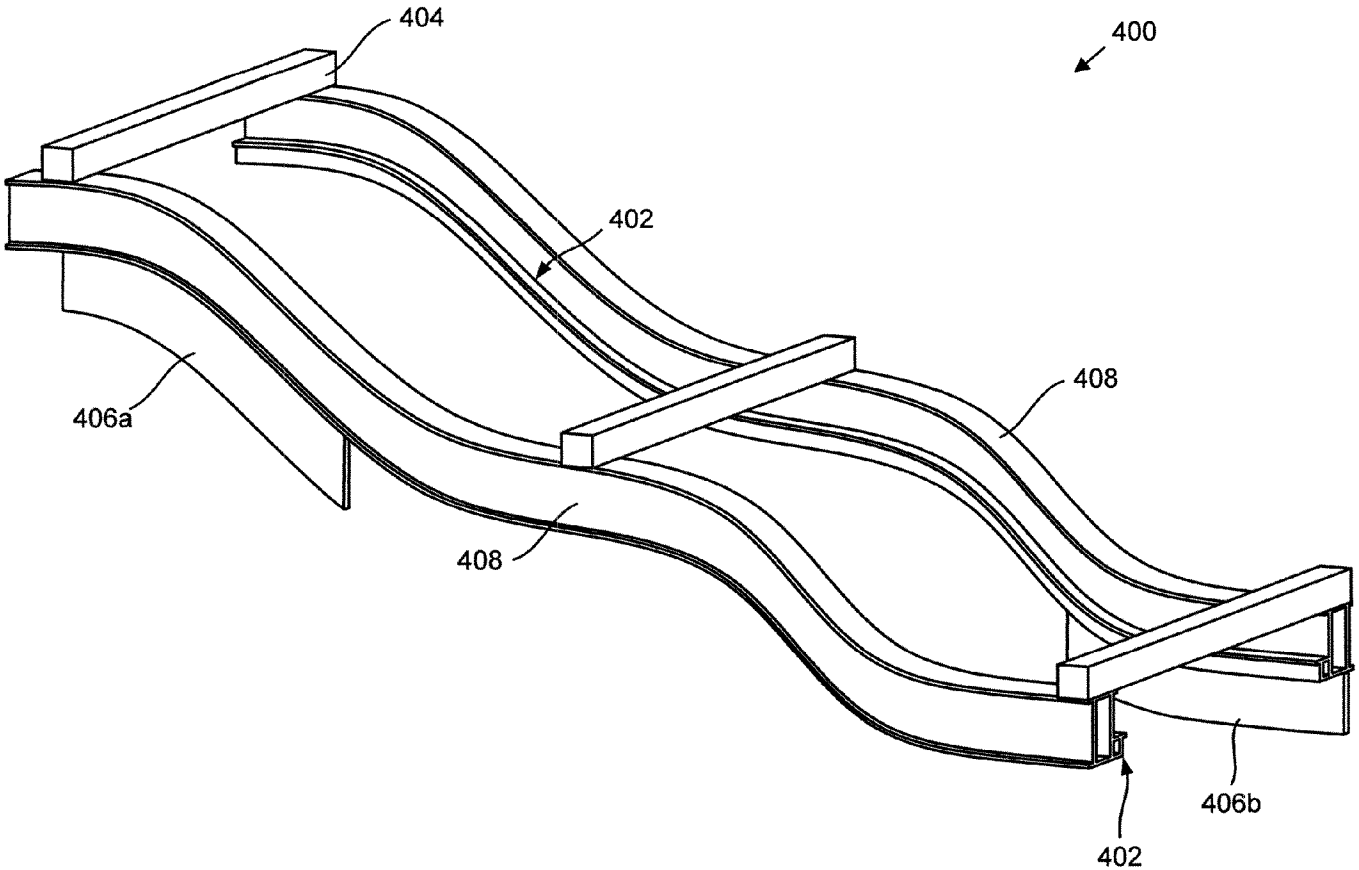
FIG. 4 illustrates an isometric perspective view of a portion of an amusement ride track consistent with embodiments of the present disclosure.

FIG. 4 is a perspective view of a portion of a roller coaster track 400, according to one embodiment. The track 400 includes rails 402 on which a vehicle may ride, such as the vehicles of FIGS. 1 and 3. For example, wheels of a vehicle may engage the rails 402 and ride on track 400 as a vehicle moves. The track also includes a frame for stabilizing and supporting the track rails 402. For example, the frame may include cross pieces 404 for securing the rails 402 relative to each other. The frame may also include runners 408 that co-extend with and support the rails 402. The frame may include posts, arms or any other structure for supporting a portion of the track 400 in a desired position or at a desired height or location. The frame may be structured to support the track 400 and the vehicle and passengers at the speeds or forces expected during use.

The track 400 also includes fins 406*a*, 406*b* for controlling rotation of a portion of vehicle mounted on the track 400. For example, the fins 406*a*, 406*b* may operate in the manner described above in relation to the track-mounted fin 306 of FIG. 3. In one embodiment, the fins 406*a*, 406*b* are positioned to induce or inhibit spinning of a passenger chassis 104 based on a speed of the vehicle at a specific location on a track. For example, if the fins 406*a*, 406*b* are located at the bottom of a large slope a vehicle may have a large amount of speed and the fins 406*a*, 406*b* may cause the passenger chassis 104 to increase a rate of spin. On the other hand, if the fins 406*a*, 406*b* are located at an end of a roller coaster ride, the vehicle will likely have a lower rate of speed and the fins 406*a*, 406*b* may cause a spinning passenger chassis 104 to slow its rate of rotation. Some portions of the track may be free from fins 406*a*, 406*b* while other portions of the track may have fins 406*a*, 406*b*.

In one embodiment, fins 406*a*, 406*b* may be used on different rails to cause passenger chassis 104 on different rails to rotate at different times or at different rates. For example, fin 406*a* is located proximate to one rail 402 while the other fin 406*b* is located proximate to another rail 402. With a vehicle having a plurality of passenger chassis 104 that have spin hubs 110, which engage fins 406*a*, 406*b* on different rails, the same roller coaster track 400 may provide a different experience based on which passenger chassis 104 a passenger rides. The rotation may provide increased control and exhilaration because rotation of a passenger may be induced at the top of a drop off, at the bottom, during a loop, or at any other desired location. Similarly, a passenger in the passenger chassis 104 may be oriented upside down, horizontal, or in any other orientation for different portions of a ride.

The configuration of the track-mounted fins 406*a*, 406*b* may be varied to produce a desired result. For example, a length of a fin 406*a*, 406*b* may affect how quickly a passenger chassis 104 rotates or a position of the chassis. For example, a shorter fin may only cause the passenger chassis 104 to tilt and not to perform a full rotation. Similarly, if a sustained tilt is desired, periodic use of short fins may help maintain a desired tilt for a length of the track. Similarly, other factors, such as thickness of the fins 406*a*, 406*b*, can be used to control an amount of force imparted to the spin hub 110.

Figure 5:
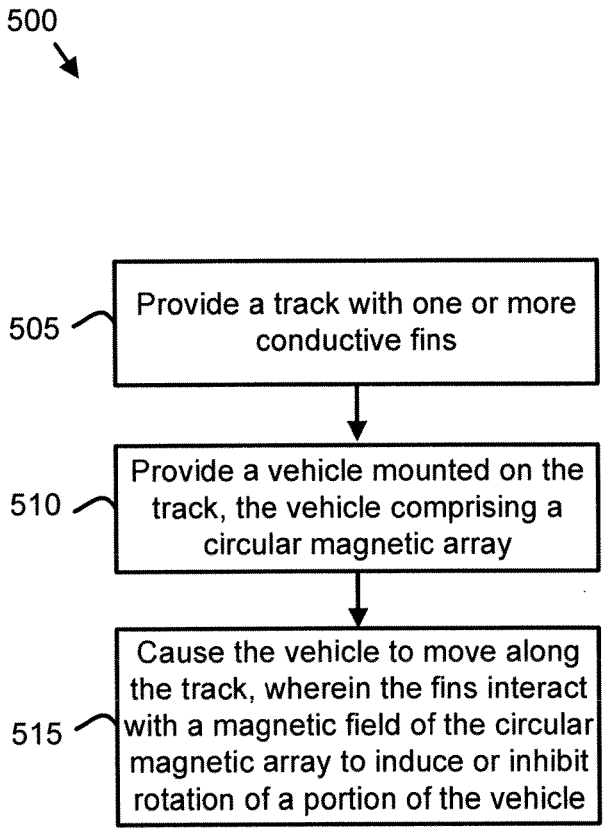
FIG. 5 illustrates a schematic flow chart diagram of a method for magnetic spin control on an amusement ride consistent with embodiments of the present disclosure.

FIG. 5 is a schematic flow chart diagram illustrating a method 500 for magnetic spin control on an amusement ride. The method 500 may be performed using any of the embodiments disclosed herein or by an owner or operator of an amusement ride The method 500 includes providing 505 a track with one or more conductive fins and providing 510 a vehicle mounted on the track. The vehicle may include a circular magnetic array and the fins may be positioned to interact with a magnetic field created by the magnetic array when the vehicle travels over a corresponding part of the track. The fins, vehicle, and magnetic array may have any of the variations discussed in relation to the disclosed embodiments. The vehicle may include a chassis-mounted fin as well to inhibit rotation of a passenger chassis with respect to other parts of the vehicle.

The method 500 also includes causing 515 the vehicle to move along the track. Causing 515 the vehicle to move along the track may include moving the vehicle using a cable, lift or other device to move the vehicle to a high point on the track where the vehicle is released and allowed to gain speed and momentum on a downward slope. In one embodiment, causing 515 the vehicle to move along the track includes accelerating the vehicle using a motor or engine in the track or vehicle.

As the vehicle moves along the track the track-mounted fins interact with the magnetic field created by the circular magnetic array to induce or inhibit rotation of a portion of the vehicle. For example, the fins may interact with the magnetic field to create a force opposing relative motion between the magnetic array and the fins. Depending on the relative speed of the vehicle and the track, the interaction between the fins and magnetic array may result in an acceleration or deceleration of rotation of the portion of the vehicle. In one embodiment, the portion of the vehicle that rotates may include a passenger chassis 104 that rotates along a horizontal or vertical axis, relative to the passengers.

It will be understood by those having skill in the art that changes may be made to the details of the above-described embodiments without departing from the underlying principles presented herein. For example, any suitable combination of various embodiments, or the features thereof, is contemplated.

Any methods disclosed herein comprise one or more steps or actions for performing the described method. The method steps and/or actions may be interchanged with one another. In other words, unless a specific order of steps or actions is required for proper operation of the embodiment, the order and/or use of specific steps and/or actions may be modified.

Throughout this specification, any reference to "one embodiment," "an embodiment," or "the embodiment" means that a particular feature, structure, or characteristic described in connection with that embodiment is included in at least one embodiment. Thus, the quoted phrases, or variations thereof, as recited throughout this specification, are not necessarily all referring to the same embodiment.

Similarly, it should be appreciated that in the above description of embodiments, various features are sometimes grouped together in a single embodiment, figure, or description thereof for the purpose of streamlining the disclosure. This method of disclosure, however, is not to be interpreted as reflecting an intention that any claim requires more features than those expressly recited in that claim. Rather, inventive aspects lie in a combination of fewer than all features of any single foregoing disclosed embodiment. It will be apparent to those having skill in the art that changes may be made to the details of the above-described embodiments without departing from the underlying principles set forth herein. The scope of the present invention should, therefore, be determined only by the following claims.

The invention claimed is:

1. An apparatus for magnetic spin control comprising:

a main chassis configured to ride on a track;

a passenger chassis rotatably coupled to the main chassis, the passenger chassis configured to support one or more passengers;

a circular magnetic array coupled to the passenger chassis such that the passenger chassis rotates with the circular magnetic array; and a chassis-mounted fin coupled to the main chassis and extending into a magnetic field of the circular magnetic array, the chassis-mounted fin configured to dampen rotation of the passenger chassis with respect to the main chassis, wherein the circular magnetic array is configured to receive a track-mounted fin within the magnetic field to induce rotation of the passenger chassis with respect to the main chassis, wherein the circular magnetic array comprises opposing magnets defining a gap and wherein the chassis-mounted fin extends into the magnetic field in the gap from a first side of the circular magnetic array and wherein a second side of the gap is unobstructed to allow a track-mounted fin to pass through the gap.

2. The apparatus of claim 1, wherein the opposing magnets are arranged to form circles on opposite sides of the gap.

3. The apparatus of claim 1, wherein the circular magnetic array comprises a plurality of permanent magnets.

4. The apparatus of claim 1, wherein the passenger chassis extends laterally from the main chassis such that the passenger chassis is supported to a side of the track when the main chassis is on the track.

5. The apparatus of claim 1, wherein the passenger chassis is rotatable around a horizontal axis with respect to a seat of the passenger chassis.

6. The apparatus of claim 1, wherein the circular magnetic array opposes movement of a fin with respect to the magnets such that a track-mounted fin provides a force to overcome a force created by the chassis-mounted fin to cause rotation of the passenger chassis relative to the main chassis.

7. The apparatus of claim 1, wherein the chassis-mounted fin and the circular magnetic array are configured to operate as an eddy current brake.

8. A system for magnetic spin control on an amusement ride, the system comprising:

a track for supporting and guiding a track-mounted vehicle, the track comprising one or more track-mounted fins positioned to control rotation of a passenger chassis of the track-mounted vehicle; and a track-mounted vehicle comprising, a main chassis configured to ride on a track;

a passenger chassis rotatably supported on the main chassis, the passenger chassis configured to support one or more passengers; a circular magnetic array coupled to the passenger chassis, the circular magnetic array comprising opposing magnets defining a gap and generating a magnetic field in the gap, wherein the gap is configured to selectively receive one or more fins to induce or inhibit rotation of the passenger chassis; and a chassis-mounted fin coupled to the main chassis and extending into the gap of the circular magnetic array, the chassis-mounted fin configured to dampen rotation of the passenger chassis with respect to the main chassis;

wherein the circular magnetic array is configured to receive the one or more track-mounted fins within the magnetic field to induce rotation of the passenger chassis with respect to the main chassis.

9. The system of claim 8, wherein the opposing magnets are arranged to form circles on opposite sides of the gap.

10. The system of claim 8, wherein the opposing magnets comprise at least three arrays defining at least two gaps, wherein the two gaps are configured to each receive a fin.

11. The system of claim 8, wherein the circular magnetic array comprises a plurality of permanent magnets.

12. The system of claim 8, wherein the passenger chassis extends laterally from the main chassis such that the passenger chassis is supported to a side of the track when the vehicle is on the track.

13. The system of claim 8, wherein the passenger chassis is rotatable around a vertical axis with respect to a seat of the passenger chassis.

14. The system of claim 8, wherein the circular magnetic array opposes movement of a fin with respect to the magnets such that the one or more track-mounted fins provides a force to cause rotation of the chassis to match a relative speed between the vehicle and the track.

15. The system of claim 8, wherein the chassis-mounted fin is coupled to a passenger chassis support.

16. The system of claim 8, wherein the chassis-mounted fin extends into the gap from a first side of the circular magnetic array and wherein a second side of the circular magnetic array substantially opposite from the first side is unobstructed to selectively interact with the one or more track-mounted fins.

17. A method for operating an amusement ride, the method comprising:

providing a track for supporting and guiding a track-mounted vehicle, the track comprising one or more track-mounted fins positioned to control rotation of a passenger chassis of the track-mounted vehicle; and providing a track-mounted vehicle comprising, a main chassis configured to ride on a track;

a passenger chassis rotatably supported on the main chassis, the passenger chassis configured to support one or more passengers;

a circular magnetic array coupled to the passenger chassis, the circular magnetic array comprising opposing magnets defining a gap and generating a magnetic field in the gap, wherein the gap is configured receive one or more fins to induce or inhibit rotation of the passenger chassis; and a chassis-mounted fin coupled to the main chassis and extending into the gap of the circular magnetic array, wherein the chassis-mounted fin extends into the gap from a first side of the circular magnetic array and wherein a second side of the circular magnetic array is unobstructed to engage the one or more track-mounted fins; and causing the vehicle to move along the track, wherein the chassis-mounted fin configured to dampen rotation of the passenger chassis with respect to the main chassis, and wherein the one or more track-mounted fins selectively pass through the gap of the circular magnetic array to control rotation of the passenger chassis.

18. The method of claim 17, wherein providing the track comprises providing a track comprising a fin located where the vehicle will have a high speed to induce spinning.

19. The method of claim 17, wherein providing the track comprises providing a track comprising a fin located where the vehicle will have a low speed to inhibit spinning.

20. The method of claim 17, wherein causing the vehicle to move along the track comprises towing the vehicle to a high point and allowing the vehicle to coast down a slope of the track.

* * * * *